United States Patent [19]

Kenmochi et al.

[11] Patent Number: 4,885,042

[45] Date of Patent: Dec. 5, 1989

[54] METHOD AND APPARATUS FOR PRELIMINARY TREATMENT OF STAINLESS STEEL FOR COLD ROLLING

[75] Inventors: Kazuhito Kenmochi; Akihiko Fukuhara; Tomio Komatu; Masanori Kitahama; Hideo Abe; Akira Kishida; Fumiya Yanagishima; Makoto Kobayashi, all of Chiba, Japan

[73] Assignee: Kawasaki Steel Corp., Japan

[21] Appl. No.: 195,723

[22] Filed: May 18, 1988

[51] Int. Cl.[4] ..... C21D 8/00

[52] U.S. Cl. ..... 148/12 E; 148/12 EA; 148/156; 266/112; 266/103; 266/102

[58] Field of Search ..... 148/12 E, 12 EA, 156; 266/103, 102, 112, 106

[56] References Cited

U.S. PATENT DOCUMENTS 4,550,487 11/1985 Hoshino et al. ..... 148/12 E

FOREIGN PATENT DOCUMENTS 884806 11/1971 Canada ..... 148/12 EA 59-23824 2/1984 Japan ..... 148/12 E

*Primary Examiner*—Deborah Yee

*Attorney, Agent, or Firm*—Austin R. Miller

[57] ABSTRACT

A process of producing cold rolled stainless steel strip, according to the invention, includes preliminary treatment for hot rolled stainless steel strip, in which preliminary treatment, hot rolled stainless steel strip is, at first, treated through annealing and picking process and is subsequently subject cold rolling without introducing rolling mill lubricant at a reduction of more than 5%. The process of preliminary treatment for preparation of cold rolling is useful for producing high surface brightness cold rolled stainless steel strip, which can achieve both of satisfactory quality and high efficiency.

4 Claims, 2 Drawing Sheets

METHOD AND APPARATUS FOR PRELIMINARY TREATMENT OF STAINLESS STEEL FOR COLD ROLLING

BACKGROUND OF THE INVENTION

1. Field of the Invention

The present invention relates generally to a preliminary treatment for a stainless steel which is to be processed by a cold rolling mill for producing cold rolled stainless steel with high surface brightness or glossiness. More specifically, the invention relates to a method and apparatus for performing preliminary treatment for hot rolled stainless steel strip for obtaining high quality cold rolled stainless steel strip with high surface glossiness through cold rolling process.

2. Description of the Background Art

It is known for producing cold rolled stainless steel strip to perform a preliminary treatment by the process of intermediate annealing and pickling. The preliminarily treated stainless steel strip is cold rolled by means of a Sendzimir mill having a work roll of 100 mmϕ or less, and so forth. Rolling mill lubricant is supplied to the mill during the cold rolling process. After cold rolling, the stainless steel strip is treated by finishing annealing and pickling. Thereafter, temper rolling is performed with draft of 0.5% to 1.2%.

The cold rolled stainless steel can be generally classified as ferritlic stainless steel, such as SUS430 and austenitic stainless steel, such as SUS304. As is well known, the ferritic stainless steel strip is generally used as a lining material for constructions, surface material of home facilities, or various decorative facilities. For this, such ferritic stainless steel strip must have satisfactorily high surface glossiness or brightness after the temper rolling process. On the other hand, the austenitic stainless steel strip is used for kitchen appliances because of higher corrosion resistance than ferritic stainless steel strip. Such austenitic stainless steel strip is usually subjected to buffing after temper rolling. After the buffing process, the austenitic stainless steel strip must have a satisfactorily high surface glossiness or brightness.

In order to obtain a satisfactorily high surface glossiness or brightness, various cold rolling processes for ferritic and austenitic stainless steel strip have been proposed. For example, Japanese Patent First (unexamined) Publication (Tokkai) Showa 60-227904 and Japanese Patent First Publication (Tokkai) Showa 61-49705 propose improvement of the cold rolling process by seeking optimum work roll diameter and surface roughness of the work roll to be utilized in the cold rolling mill. On the other hand, Japanese Patent First Publication (Tokkai) Showa 58-56013 proposes improvement on intermediate pickling process. Furthermore, Japanese Patent First Publication (Tokkai) Showa 59-107027 proposes addition of grinding after intermediate annealing and pickling process.

Such improvements are generally successful in improving quality of the stainless steel strip and for providing higher surface glossiness or brightness. However, such prior proposals are not satisfactory in providing satisfactorily high surface glossiness or brightness for products, such as the BA product, which is requires very high surface glossiness or brightness.

In the meantime, in recent years, there is a tendency to seek higher production efficiency in producing high surface brightness stainless steel strip. For this requirement, a tandem cold rolling mill having a greater work roll diameter than that of the Sendzimir mill, has tended to be used in place of Sendzimir mill. Such tandem mill with an increased diameter work roll achieves higher efficiency. That is, significant reduction of process time can be achieved by allowing one way rolling utilizing the tandem mill, since the process otherwise required bi-directional rolling in a Sendzimir mill. Furthermore, because a greater amount of rolling mill lubricant can be introduced between the roll surface and the stainless steel strip surface to avoid direct contact of the roll surface onto the strip surface, this successfully prevented the strip from forming defects such as heat-streaks.

On the other hand, a greater amount of rolling mill lubricant introduced between the mating surfaces of the roll and strip tends to cause difficulty in control of surface roughness of the strip. As a result, surface roughness of the stainless steel strip after rolling becomes substantially great. This clearly degrades surface brightness or glossiness of the stainless steel strip.

In order to improve such defect in the tandem cold rolling mill in production of high surface brightness stainless steel strip, there have been proposed various improvements. For example, Japanese Patent First Publication (Tokkai) Showa 61-23720 proposes to perform intermediate annealing and pickling after cold rolling and subsequently to perform cold rolling once again. On the other hand, Japanese Patent First Publication (Tokkai) Showa 61-49701 proposes a cold rolling process in which cold rolling utilizing a small diameter work roll is performed subsequently to cold rolling by a large diameter work roll. Such improvements successfully improve surface quality of the stainless steel strip to be produced through the cold rolling process. However, providing an additional steps, i.e. intermediate annealing and pickling after cold rolling and additional cold rolling by a small diameter work roll, requires additional process time and lower efficiency. Degradation of the production efficiency is significant because intermediate annealing and pickling or cold rolling utilizing a small diameter work roll is performed at substantially reduced line speed in comparison with that in cold rolling utilizing a large diameter work roll.

SUMMARY OF THE INVENTION

Therefore, it is an object of the present invention to provide a method and apparatus for producing a high surface brightness cold rolled stainless steel strip, which can achieve both satisfactory quality and high efficiency.

Another object of the invention is to provide a method and apparatus for performing preliminary treatment for hot rolled stainless steel strip to be processed through a cold rolling process, which allows production of satisfactory quality and high efficiency.

In order to accomplish the aforementioned and other objects, a process of producing cold rolled stainless steel strip, according to the invention, includes preliminary treatment for a hot rolled stainless steel strip, in which preliminary treatment the hot rolled stainless steel strip is, at first, treated through an annealing and picking process and is subsequently subjected to cold rolling without introducing rolling mill lubricant, at a reduction of more than 5%.

According to one aspect of the invention, a method is provided for preliminary treatment of a stainless steel strip for preparation of a cold rolling process for producing a stainless steel strip with high surface brightness, comprising the steps of:

performing annealing and pickling for a hot rolled strip; and subsequently performing rolling without introducing lubricant into a rolling mill.

According to another aspect of the invention, an apparatus for preliminary treatment of a stainless steel strip is provided for preparation of a cold rolling process for producing a stainless steel strip with high surface brightness, and comprises means for performing annealing and pickling for a hot rolled strip, and means for receiving processed stainless steel strip from the annealing and pickling means and subsequently performing rolling without introducing lubricant into a rolling mill.

Preferably, reduction in the rolling is greater than 5%.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DETAILED DESCRIPTION OF THE INVENTION

Figure 1:
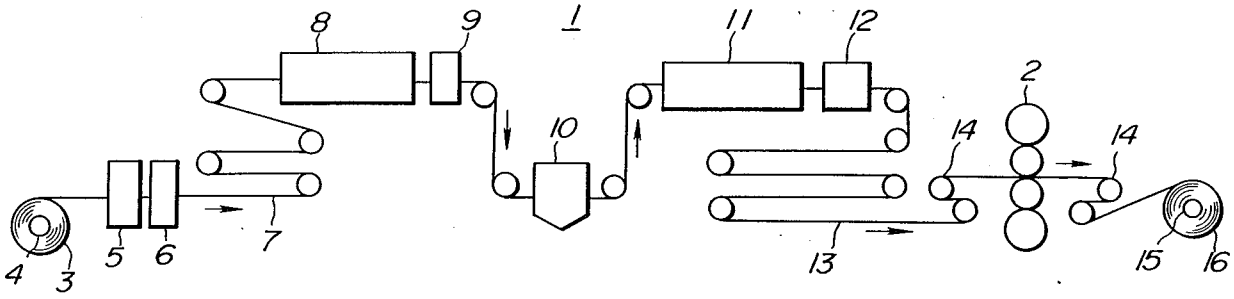
FIG. 1 is a fragmentary and diagramatic illustration of the preferred embodiment of apparatus for preliminary treatment of a stainless steel strip for cold rolling in production of high surface brightness stainless steel strip.

Referring now to the drawings, particularly to FIG. 1, the preferred embodiment of a preliminary treatment apparatus for performing preliminary treatment of a hot rolled strip for preparation for cold rolling in production of a cold rolled stainless steel strip with high surface brightness or glossiness, generally comprises an intermediate annealing and pickling stage 1 and a non-lubricating rolling stage.

The intermediate annealing and pickling stage 1 includes a continuous heating furnace 8 and a pickling bath 11. The non-lubricating rolling mill 2 constituting the non-lubricating rolling stage is provided downstream of the pickling bath 11. The rolling may be a multi-stand tandem mill, such as a 2 High, 4 High, 6 High mill, cluster type mill or so forth. Though the shown embodiment employs a single mill in the non-lubricating rolling stage, it is possible to employ more one mill if necessary. The mill to be employed in the non-lubricating rolling stage is required a capacity to have shape control the so as to control flatness of the strip to be rolled.

For example, as shown in FIG. 1, a hot rolled stainless steel strip coil 3 wound on a pay off reel 4 is rolled out. Leading edge of the hot rolled stainless steel strip is cut by a shear device 5. Then, the leading edge is connected to the trailing edge of former strip by way of welding in a welding device 6 to form a continuous strip. The continuous strip is introduced into the contineous heating furnace 8 which serves as an annealing furnace, via an inlet side looper 7. In the heating furnace 8, the hot rolled stainless steel strip is subjected to annealing process. The annealed strip is fed from the heating furnace 8 to the pickling bath 11 via a cooling zone 9 provided downstream of the heating furnace and a mechanical descalling equipment 10 for removing oxidation scale from the strip surface. In the pickling bath 11, oxidation scale remaining on the surface of the stainless steel strip is completely removed. Then, the stainless steel strip is fed through a washing and drying device 12.

The stainless steel moving past the washing and drying device 12 is fed to the non-lubricating rolling stage via an outlet side looper 13. In the non-lubricating rolling stage, tension bridle rolls 14 are provided at orientations upstream and downstream of the non-lubricating rolling mill 2. The non-lubricating rolling mill 2 is designed to perform rolling for the stainless steel strip at a reduction greater than 5%. The preliminary treated stainless steel strip 16 thus treated is wound on a tension reel 15.

In general, in order to obtain high surface brightness on the cold rolled stainless steel strip as product, it is essential to reduce surface roughness. The surface roughness of the product strip is generally determined by the surface roughness of the material strip produced through the cold rolling process. Namely, surface roughness in the material strip produced through the cold rolling process determines the quality of cold rolled stainless steel strip product.

In observation, it is found that the surface roughness on the stainless steel strip after cold rolling process, resides in uneveness originally existing on the stainless steel strip before cold rolling and maintained even after the cold rolling process. In the present, in order to provide satisfactorily high surface brightness on the surface of the stainless steel strip, an average surface roughness Ra, as measured by the difference of surface level at projecting peak and bottom of impression, has to be 0.1 μm or less. In observation, it is also found that the average surface roughness Ra of the stainless steel strip after the pickling process is 2 to 4 μm, because uneveness is created by mechanical descaling, for example, shot blasting and by corrosion by the presence of acid in the pickling bath 11, such as nitric acid.

When such stainless steel strip holding substantially great surface roughness, i.e. an average roughness Ra of 2 to 4 μm, is directly fed to the cold rolling mill for cold rolling with presence of a rolling mill lubricant, the lubricant tends to be accumulated within depressions of uneveness on the surface of the stainless steel strip. The lubricant accumulated within the depression is carried with the stainless steel strip to the portion where the surface of the strip contacts the peripheral surface of the work roll. This lubricant held within the depression of the stainless steel strip serves as resistance to reduction. Therefore, even after cold rolling, uneveness originally held on the surface of the stainless steel strip past the pickling process, can be substantially held unchanged though a little reduction is achieved. Leaving of substantial uneveness on the surface degrades the surface brightness of the stainless steel strip as a cold rolled stainless strip product, and thus degrades the quality of the products.

From the observation set forth above, it is found essential to reduce the surface roughness before feeding the strip to the cold rolling process. As will be appreciated, reduction of the surface roughness can be achieved by performing a smoothing process by way of rolling or by performing a grinding process. In order to obtain sufficient reduction of the surface roughness by way of grinding process, it is required to provide a substantially long process time, e.g. about 4 to 5 hours. Therefore, reduction of surface roughness by a grinding process is not practically acceptable.

Therefore, it is preferred to perform the rolling process for reducing the surface roughness of the stainless steel strip before feeding the strip to the cold rolling mill. In the surface roughness reducing rolling process, rolling mill lubricant if present, will interfere with reduction of roughness as discussed with respect to cold rolling. Therefore, the rolling mill lubricant is better not supplied to the rolling mill to be used for reduction of the surface roughness of the stainless steel strip. In addition, reduction in the roughness reducing rolling process is selected to be greater than 5% so as to obtain satisfactory reduction of the surface roughness.

Figure 2:
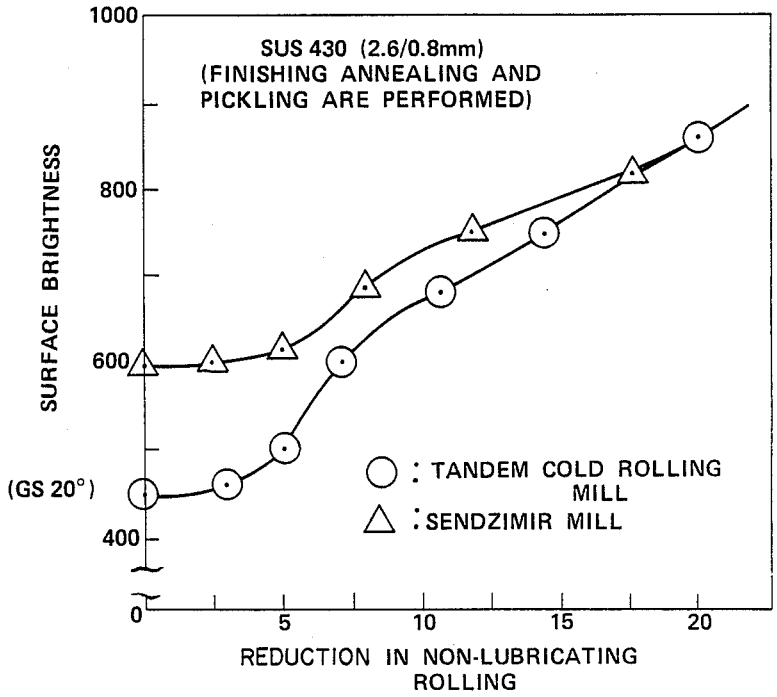
FIG. 2 is a graph showing variation of surface brightness in relation to reduction in non-lubricating cold rolling.

The optimum reduction of roughness reducing rolling is sought through experiments by performing rolling at various reductions. The experimentarily rolled strips through the non-lubricating rolling mill are processed through a cold rolling process with rolling mill lubricant, finished annealing and pickling and temper rolling process. The surface brightness of the obtained strips through the aforementioned process are checked. Measurement of the surface roughness of the respective experimentarily obtained strips is performed by a method according to Japanese Industrial Standard (JIS) Z 8741: "Method of measurement of brightness (GS20°)". The result of measurement is shown in the graph of FIG. 2. As will be seen from FIG. 2, in either case of rolling utilizing a tandem mill with a large diameter work roll and a Sendzimir mill with a small diameter work roll, surface brightness is held substantially unchanged when the reduction is less than or equal to 5% but significantly enhanced when the reduction exceeds 5%.

As will be understood, non-lubricating rolling allows direct contact between the surface of the stainless steel strip and the peripheral surface of the work roll and thus tends to cause burning on the strip surface. In order to avoid the possibility of burning on the surface of the stainless steel strip, it is necessary to control line speed to be sufficiently low. However, since the non-lubricating rolling is performed at the outlet side of the intermediate annealing and pickling stage or the inlet side of the cold tandem mill, low line speed at the non-lubricating rolling mill will not significantly affect to the line speed of the cold rolling mill and thus the efficiency of the rolling process. In the shown embodiment, the non-lubricating rolling mill is arranged at the outlet side of the intermediate annealing and pickling stage 1.

EXAMPLES

In order to demonstrate advantages provided by the present invention, experiments are performed. In the experiments, stainless steel strips having widths and thickness shown in the appended table 1, were processed by non-lubricating rolling under the rolling condition shown in the appended tables 2(A) and 2(B) and table 3(A) and 3(B). After non-lubricating rolling, the strips were subject cold rolling by means of the tandem mill and Sendzimir mill. The cold rolled strips were processed by finishing annealing and pickling and subsequently by temper rolling. For the austenitic stainless steel strip in the table 3(A) and 3(B), buffing was performed after temper rolling process. Visual brightness of ferritlic stainless steel strips as results of experiments are shown in table 2(A) and 2(B) and visual brightness of austenitic stainless steel strips as results of experiments are shown in table 3(A) and 3(B). The visual brightness level indicated in the tables 2(A) and 2(B) and table 3(A) and 3(B) is classified into five levels special A, A, B, C and D in order of high level to low level. Namely, the strip having the highest surface brightness level is classified at special A level and the step having the lowest surface brightness level is classified at D level.

In order to compare the surface brightness with that of the strips produced by the process according to the invention, comparative experiments were also performed. In the comparative experiments, stainless steel strips were produced by the conventional process which does not have the non-lubricating rolling step. In addition, another comparative experiments were performed by reducing draft in non-lubricating rolling less than 5%. The results of these comparative experiments are also shown in tables 2(A). 2(B), 3(A) and 3(B).

As will be clear from the results of experiments shown in the tables 2(A), 2(B), 3(A) and 3(B), surface brightness of the stainless steel strips produced through the process according to the present invention, is much higher than that of the comparative examples. The surface brightness level obtained through the process according to the invention, exhibits equivalent quality to that produced by cold rolling utilizing Sendzimir mill which is significantly less efficient than that of the process of the invention.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

TABLE 1

| | Kind of Strip | Strip Thickness After intermediate Pickling (mm) | Strip Thickness in Product (mm) |
|---|---|---|---|
| a | | 1.8 | 0.40 |
| b | Ferritlic | 2.6 | 0.80 |
| c | SUS430 | 4.0 | 1.50 |
| d | | 2.0 | 0.05 |
| e | Austenitic | 3.0 | 1.50 |
| f | SUS304 | 4.0 | 2.00 |

TABLE 2(A)

Kind of stainless steel is ferritlic stainless; tandem mill is used; and after cold rolling finishing annealing and pickling is performed.

| | | Non-Lubricating Rolling | | Surface Brightness After | |
|---|---|---|---|---|---|
| | | Draft % | Maximum Line Speed (mpm) | Temper Rolling (GS20°) | Visual Brightness Level |
| Invention | d | 7.0 | 45 | 680 | B |
| | e | 7.3 | 45 | 610 | B |
| | f | 6.5 | 55 | 550 | B-C |
| | d | 13.0 | 30 | 800 | A |
| | e | 14.5 | 30 | 750 | B |
| | f | 10.0 | 40 | 630 | B |
| | d | 23.3 | 15 | 910 | A |

TABLE 2(A)-continued

Kind of stainless steel is ferritlic stainless; tandem mill is used; and after cold rolling finishing annealing and pickling is performed.

| | | Non-Lubricating Rolling | | Surface Brightness After | |
|---|---|---|---|---|---|
| | | Draft % | Maximum Line Speed (mpm) | Temper Rolling (GS20°) | Visual Brightness Level |
| | e | 20.5 | 20 | 870 | A |
| | f | 17.8 | 25 | 790 | B |
| Comparative | d | 2.0 | 100 | 510 | C |
| | e | 5.0 | 60 | 490 | D |
| | f | 1.0 | 200 | 380 | D |
| Prior Art | d | | — | 500 | C |
| | e | — | — | 450 | D |
| | f | — | — | 380 | D |

TABLE 2(B)

Kind of stainless steel is ferritlic stainless; Sendzimir mill is used; and after cold rolling finishing annealing and pickling is performed. The experiments indicated with "*" is performed by bright annealing.

| | | Non-Lubricating Rolling | | Surface Brightness After | |
|---|---|---|---|---|---|
| | | Draft % | Maximum Line Speed (mpm) | Temper Rolling (GS20°) | Visual Brightness Level |
| Invention | d | 7.0 | 45 | 900 | A |
| | e | 12.0 | 35 | 750 | B |
| | f | 8.0 | 45 | 630 | B |
| Comparative | d | 1.0 | 200 | 830 | A |
| | e | 5.0 | 60 | 610 | B |
| | f | 2.5 | 85 | 550 | B–C |
| Prior Art | d | — | — | 830 | A |
| | e | — | — | 600 | B |
| | f | — | — | 550 | B–C |
| Invention | d* | 10.0 | 40 | 1000 | Special A |
| | e* | 7.0 | 45 | 730 | B |
| | f* | 15.5 | 25 | 800 | A |
| Comparative | d* | 0.5 | 200 | 900 | A |
| | e* | 2.5 | 85 | 650 | B |
| | f* | 4.5 | 55 | 620 | B |
| Prior Art | d* | — | — | 900 | A |
| | e* | — | — | 650 | B |
| | f* | — | — | 600 | B |

TABLE 3(A)

Kind of stainless steel is austenitic stainless; tandem mill is used; and after cold rolling finishing annealing and pickling is performed.

| | | Non-Lubricating Rolling | | Surface Brightness After | |
|---|---|---|---|---|---|
| | | Draft % | Maximum Line Speed (mpm) | Temper Rolling (GS20°) | Visual Brightness Level |
| Invention | a | 6.0 | 55 | 620 | B |
| | b | 7.5 | 45 | 620 | B |
| | c | 5.5 | 60 | 600 | B |
| | a | 10.0 | 40 | 710 | B |
| | b | 11.5 | 35 | 700 | B |
| | c | 8.2 | 45 | 670 | B |
| | a | 20.0 | 20 | 900 | A |
| | b | 16.0 | 25 | 820 | A |

TABLE 3(A)-continued

Kind of stainless steel is austenitic stainless; tandem mill is used; and after cold rolling finishing annealing and pickling is performed.

| | | Non-Lubricating Rolling | | Surface Brightness After | |
|---|---|---|---|---|---|
| | | Draft % | Maximum Line Speed (mpm) | Temper Rolling (GS20°) | Visual Brightness Level |
| | c | 13.5 | 30 | 780 | B |
| Comparative | a | 5.0 | 60 | 550 | B–C |
| | b | 3.0 | 75 | 500 | C |
| | c | 0.5 | 200 | 430 | D |
| Prior Art | a | — | — | 530 | C |
| | b | — | — | 480 | D |
| | c | — | — | 430 | D |

TABLE 3(B)

Kind of stainless steel is austenitic stainless; Sendzimir mill is used; and after cold rolling finishing annealing and pickling is performed. The experiments indicated with "*" is performed by bright annealing, for which experiments visual observation was performed after finishing temper rolling

| | | Non-Lubricating Rolling | | Surface Brightness After | |
|---|---|---|---|---|---|
| | | Draft % | Maximum Line Speed (mpm) | Temper Rolling (GS20°) | Visual Brightness Level |
| Invention | a | 6.0 | 55 | 810 | A |
| | b | 10.0 | 40 | 650 | B |
| | c | 7.0 | 45 | 780 | B |
| Comparative | a | 2.0 | 100 | 720 | B |
| | b | 0.5 | 200 | 600 | B |
| | c | 3.5 | 65 | 660 | B |
| Prior Art | a | — | — | 720 | B |
| | b | — | — | 600 | B |
| | c | — | — | 650 | B |
| Invention | a* | 9.5 | 40 | 1010 | Special A |
| | b* | 6.0 | 55 | 800 | A |
| | c* | 13.0 | 30 | 870 | A |
| Comparative | a* | 5.0 | 60 | 930 | A |
| | b* | 0.5 | 200 | 710 | B |
| | c* | 1.0 | 200 | 730 | B |
| Prior Art | a* | — | — | 910 | A |
| | b* | — | — | 710 | B |
| | c* | — | — | 730 | B |

What is claimed is:

1. A method for preliminary treatment of a stainless steel strip in preparation for a cold rolling process for producing a stainless steel strip having high surface brightness, comprising the steps of:

performing annealing and pickling of a hot rolled stainless steel strip; and subsequently performing rolling of said strip in a mill without introducing lubricant into said rolling mill.

2. A method for preliminary treatment as set forth in claim 1, wherein reduction in said rolling is greater than 5%.

3. An apparatus for preliminary treatment of a stainless steel strip in preparation for a cold rolling process for producing a stainless steel strip having high surface brightness, comprising:

means for performing annealing and pickling of a hot stainless steel rolled strip; and non-lubricating rolling mill means for receiving the processed stainless steel strip from said annealing and pickling means and for subsequently performing rolling without introducing lubricant into said rolling mill.

4. An apparatus for preliminary treatment as set forth in claim 3, wherein said rolling means performs rolling of said stainless steel strip at reduction of greater than 5%.

* * * * *

UNITED STATES PATENT AND TRADEMARK OFFICE

CERTIFICATE OF CORRECTION

PATENT NO. : 4,885,042

DATED : December 5, 1989

INVENTOR(S) : Kaxuhito Kenmochi, et al

It is certified that error appears in the above-identified patent and that said Letters Patent is hereby corrected as shown below:

Column 6, line 50, Table 1, change "0.05" to --0.50--.

Signed and Sealed this

Ninth Day of April, 1991

*Attest:*

HARRY F. MANBECK, JR.

*Attesting Officer*

*Commissioner of Patents and Trademarks*